US008887908B2

(12) United States Patent
Sugarek et al.

(10) Patent No.: US 8,887,908 B2
(45) Date of Patent: Nov. 18, 2014

(54) ANTI-MOVEMENT GOLF BAG BASE

(71) Applicants: Steven Sugarek, Houston, TX (US); Alan Sugarek, Houston, TX (US)

(72) Inventors: Steven Sugarek, Houston, TX (US); Alan Sugarek, Houston, TX (US)

( * ) Notice: Subject to any disclaimer, the term of this patent is extended or adjusted under 35 U.S.C. 154(b) by 100 days.

(21) Appl. No.: 13/710,595

(22) Filed: Dec. 11, 2012

(65) Prior Publication Data

US 2013/0146490 A1 Jun. 13, 2013

Related U.S. Application Data

(60) Provisional application No. 61/569,839, filed on Dec. 13, 2011.

(51) Int. Cl.
*A63B 55/00* (2006.01)

(52) U.S. Cl.
CPC ..... *A63B 55/00* (2013.01); *A63B 2055/002* (2013.01)
USPC ..... 206/315.6; 206/315.3; 211/70.2; 211/60.1

(58) Field of Classification Search
USPC ..... 206/315.3, 315.6; 211/70.2, 60.1, 69.9, 211/62
See application file for complete search history.

(56) References Cited

U.S. PATENT DOCUMENTS

| | | | | | |
|---|---|---|---|---|---|
| 2,105,853 | A | | 1/1938 | Brodie | |
| 3,290,082 | A | * | 12/1966 | Fritsch | 293/128 |
| 3,572,799 | A | * | 3/1971 | Truesdell et al. | 293/128 |
| 4,155,387 | A | | 5/1979 | Costa | |
| D279,945 | S | * | 8/1985 | Zeischegg et al. | D6/449 |
| 4,852,896 | A | | 8/1989 | Mills | |
| 5,029,703 | A | * | 7/1991 | Dulyea, Sr. | 206/315.3 |
| 5,772,024 | A | | 6/1998 | Leuders | |
| 5,947,282 | A | * | 9/1999 | Merrill et al. | 206/315.6 |
| 6,148,998 | A | * | 11/2000 | Tan | 206/315.3 |
| 6,216,864 | B1 | | 4/2001 | Chang | |
| 6,464,076 | B2 | * | 10/2002 | Tan | 206/315.6 |
| D645,274 | S | * | 9/2011 | Terada | D6/416 |

FOREIGN PATENT DOCUMENTS

| | | | | | |
|---|---|---|---|---|---|
| JP | 06015020 | A | * | 1/1994 | A63B 55/00 |
| JP | 07016318 | A | * | 1/1995 | A63B 55/00 |
| JP | 07047153 | A | * | 2/1995 | A63B 55/00 |
| JP | 09308719 | A | * | 12/1997 | A63B 55/00 |
| JP | 10108929 | A | * | 4/1998 | A63B 55/00 |

OTHER PUBLICATIONS

International Prelminary Examining Authority, International Preliminary Report, for international application PCT/US2012/068707. Jacques, Voinot, International Search Report for PCT Application, PCT Application # PCT/US2012/068707.

* cited by examiner

*Primary Examiner* — Tri Mai

(57) ABSTRACT

One embodiment of a golf bag base that securely seats the multi-sized grip ends of golf clubs within a golf bag for storage. The base is located at the bottom interior of a golf bag and has upon it a plurality of shaped partitions. Each partition is wider at its bottom end and extends upwardly and inwardly at an angle to terminate at a narrower apex end. The partitions define volumes of space between each set of adjacent partitions that are sized for both narrow and wide diameter golf club grip ends. The surfaces of the partitions frictionally secure and release the grip ends of the golf clubs with a simple twist by the user. The apex end of each partition has a rigidly flexible deflecting tip that helps to guide a golf club grip end to an adjacent available empty space within the storage base.

20 Claims, 2 Drawing Sheets

ANTI-MOVEMENT GOLF BAG BASE

CROSS-REFERENCE TO RELATED APPLICATIONS

Figure 1:
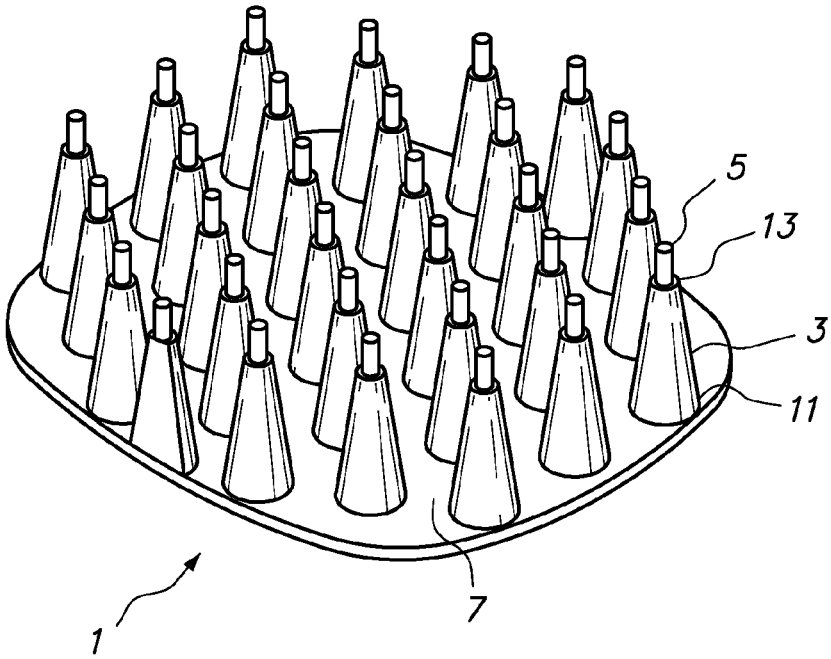

This application claims the benefit of provisional patent application Ser. No. 61/569,839 filed 2011 Dec. 13, by the present inventors, which is incorporated by reference. Please note, the application 61/569,839 was entitled, "Anti-Movement Golf Bag Base for Seizing and Deflecting Multi-Sized Golf Club Grips." However, a PCT application was desired to be filed and the PCT requirements dictated that this title was too long and therefore, per requirements, had to be shortened to, "Anti-Movement Golf Bag Base". Therefore, in filing this formal, the title has been changed to match the filing of the PCT application.

SEQUENCE LISTING OR PROGRAM

Not applicable.

BACKGROUND

1. Field of Invention

This invention relates to golf bag bases, specifically to such bases that can seize and deflect to the next available holding area a variety of multi-sized golf club grips.

2. Prior Art

Relevant prior art includes:

U.S. Patents

U.S. Pat. No. 2,105,853—Golf bag

U.S. Pat. No. 4,155,387A—Golf bag insert

U.S. Pat. No. 4,852,896A—Golf equipment carrier with rotating club reducing frame U.S. Pat. No. 5,029,703A—Golf club organizer U.S. Pat. No. 5,772,024—Golf club organizer U.S. Pat. No. 5,947,282A—Golf club organizer for a golf bag U.S. Pat. No. 6,464,076 B2—Golf club positioning bottom rack for golf bag

BACKGROUND OF THE INVENTION

Golf club bags serve a function of storing golf clubs and making these clubs accessible to the user during play. However, golf club bag designs have consistently allowed the golf clubs to spin and swivel within the bag. This high impact twisting of the golf club allows the golf club heads to contact each other and cause severe damage to one another. The golf clubs within the bag also shift positions and become severely disorganized. This occurs as the golf club bag is being carried through a game, or in storage if the golf club bag is shifted or moved. There have been several attempts at designing golf club bag bases in such a way as to organize golf clubs and leave them undamaged. U.S. Pat. No. 2,105,853 to Brodie (1938) discloses a grid base that attempts to organize golf clubs within a bag but only allows for storage of a single width golf club grip and does not prevent clubs from rotating while being stored within the grid. This similar matrix idea, albeit with much larger and much fewer partitions is present in U.S. Pat. No. 4,155,387 to Costa (1979). However, both of these designs do not prevent golf clubs from swiveling within the bag. Another attempt at securing golf clubs within a golf bag and limiting their rotation is present in U.S. Pat. No. 4,842,896 to Mills (1989) and U.S. Pat. No. 5,029,703 to Dulyea (1991). However, these complex devices require a seated base, and a securing socketed area present at the top opening of the golf bag. The golf club is snapped into place at its necks with the grip end extending down and into the bag securing bag. Even with these designs, the golf club is still able to rotate within the bag and bang into other clubs. Further, storage of the golf club cannot occur without the multiple parts working together both at the top and at the base of the bag. U.S. Pat. No. 5,772,024 to Lueders (1998) continues this concept of securing the golf club at its neck while seating the grip end of the club within a structure at the base of the bag. Again, the golf club head is able to freely swivel within the bag and cause damage to another club. U.S. Pat. No. 5,947,282 to Merrill and Schmitt (1999) continues this concept design of securing the golf club neck as a means of securing the golf club within a bag but the result is still the same; the club ends can freely rotate and there is a limit to the number of clubs that can be inserted into the bag. Finally, U.S. Pat. No. 6,464,076 B2 to Tan (2002) develops a golf club bag base that holds the grip ends of golf clubs, but cannot accommodate multiple sized grips. Further, this type of design has a basic flaw in that if the grip end hits a flat side edge of any grip seating area, then multiple repeated stabbing attempts have to occur to finally seat the golf club grip end into the bag base.

DRAWINGS

Figures

FIG. 1—A perspective view of an Anti-Movement Golf Bag Base showing a plurality of tapered surface grip seizing partitions, a set of deflector tips atop each partition, and a bottom mounting plate to which the partitions are attached.

Figure 2:
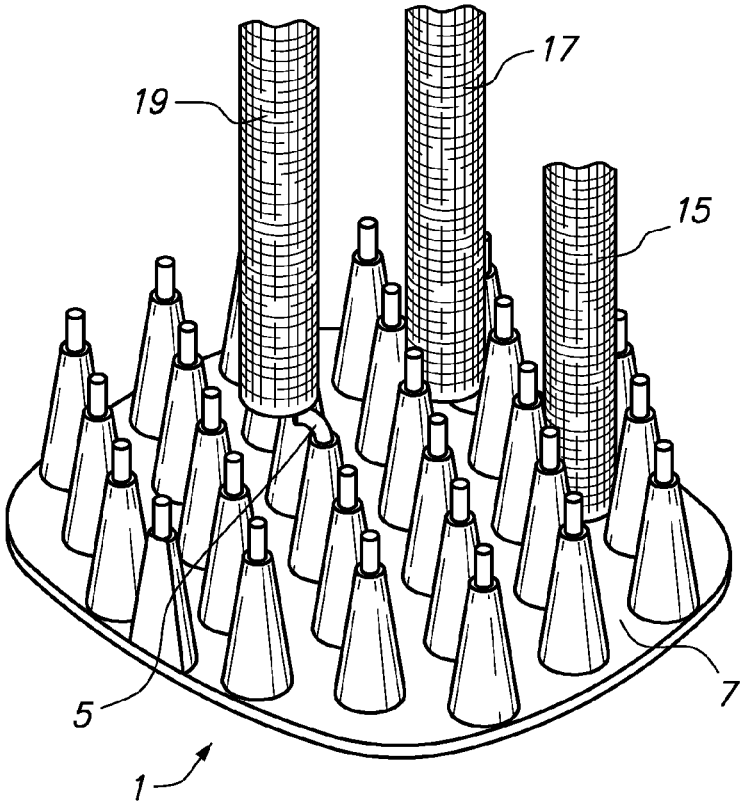

FIG. 2—A perspective view, shown partly broken away, of individual tapered surface grip seizing partitions and one of the deflector tips in use as it deflects a grip end of a golf club to a next adjacent and available grip seating position area.

Figure 3:
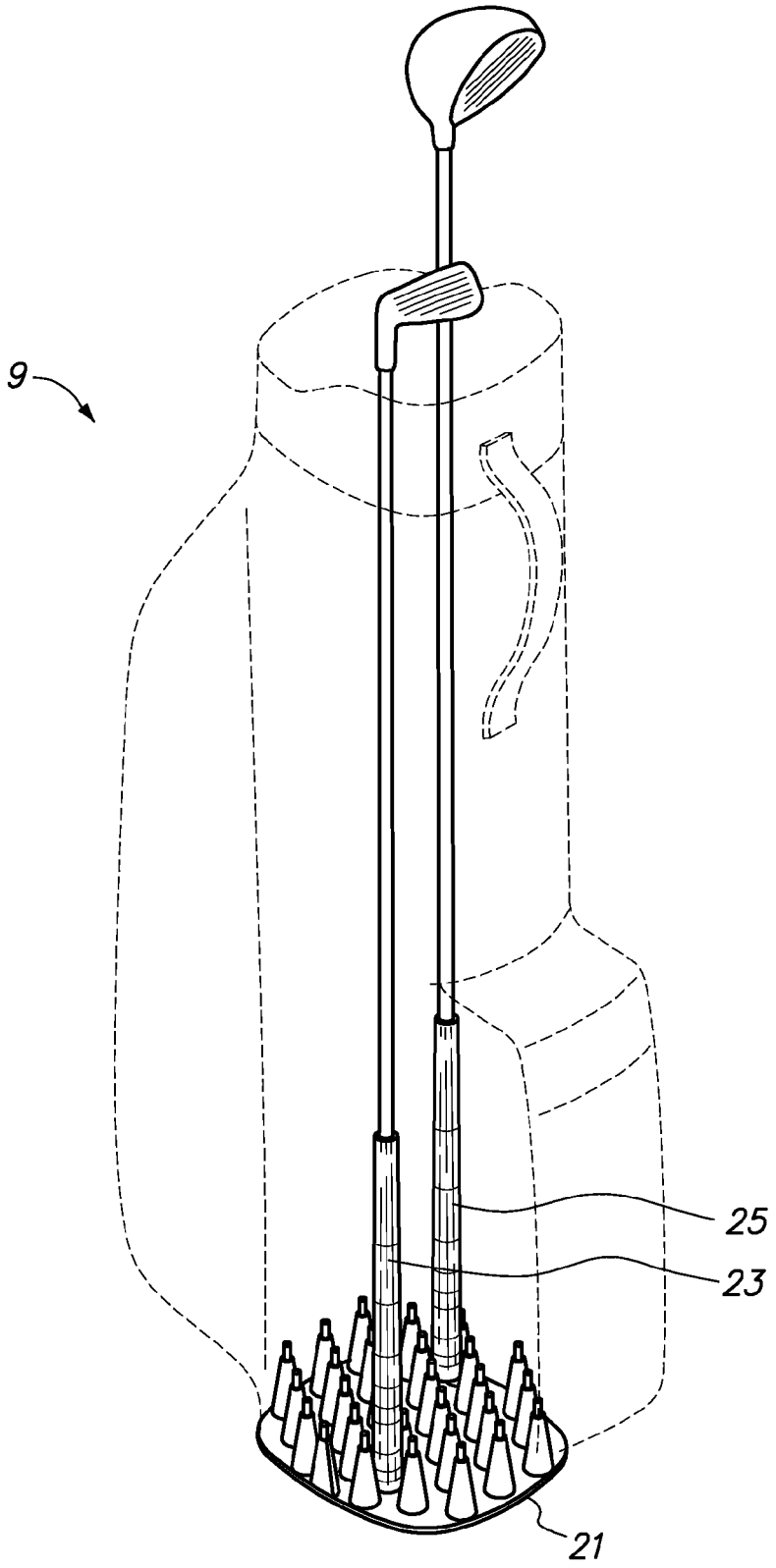

FIG. 3—A perspective of, shown partly broken away, of the Anti-Movement Golf Bag Base in its installed configuration within the bottom of a golf bag and two golf clubs of both wide and narrow radius grip ends secured therein.

LIST OF REFERENCE NUMERALS

1—bottom mounting plate

3—grip seizing partitions

5—flexible deflector tip

7—grip seating position area

9—golf bag

11—partition bottom base

13—partition apex end

15—narrower radius golf club grip

17—wider radius golf club grip

19—deflected grip end of a golf club

21—Anti-Movement Golf Bag Base in its installed configuration within a golf bag

23—narrow radius grip end golf club stored in Anti-Movement Golf Bag Base

25—wide radius grip end golf club stored in Anti-Movement Golf Bag Base

DETAILED DESCRIPTION

As shown in FIGS. 1, 2 and 3, a first embodiment comprises a plurality of grip seizing partitions 3. Each partition 3 has a partition bottom base 11 at a bottom end of the partition 3. This bottom base 11 represents the maximum width of the partition 3. The partition 3 shape then extends upwardly and inwardly at an angle to terminate at a partition apex end 13. At its partition base 11, each partition 3 is fixedly attached to a top surface of a bottom mounting plate 1 or formed thereof as part of the top surface of bottom plate 1. The bottom plate 1 has a top surface and a bottom surface and is shaped appropriately as required to match an interior shape and dimension of an interior bottom end area of a golf bag 9. Bottom plate 1 is attached to the golf bag 9.

When a minimum of any two partitions 3 are placed adjacent with each other and with either at least an inner wall of the side of the golf bag 9 or, if placed in combination with at least one other partition 3, a volume of void space is formed that is a grip seating position area 7. Said grip seating position area 7 is sized to seat a plurality of differently sized grip ends of a golf club ranging from a narrow grip end to a wide grip end. This is due to the nature of the inwardly angling shape of the partitions 3. The volume of void space that serves as said grip seating position area 7 tends to be smaller, or narrower, as one moves through the volume of void space beginning from between the partition apexes 13 and traveling to the volume of void space between the partition bases 11. Therefore, the narrow grip end of the golf club will move further through volume of void space and be secured against the partitions 3 more closely to the partition bases 11. Conversely, the volume of void space grows wider and larger as one moves upwardly from between the partition bases 11 to the volume of void space located between the partition apexes 13. Therefore, the wide grip end of the golf club will not move as far through the volume of void space and be secured against the partitions 3 nearer to the partition apex 13.

The outer surface of each partition 3 is comprised of a material that is capable of frictionally seizing and frictionally releasing a grip end of a golf club when a force is applied by the user. The minimum radius size of a narrower radius golf club grip 15 that can be frictionally seized and secured by the grip seating position areas 7 is determined by the minimum distance as measured between adjacent partition bases 11 or as measured between adjacent partition bases 11 and the adjacent interior wall of the golf bag 9. The maximum radius size of a wider radius golf club grip 17 that can be frictionally seized and secured by the grip seating position areas 7 is determined by the maximum distance as measured between adjacent partition apexes 13 or as measured between adjacent partition apexes 13 and the adjacent interior wall of the golf bag 9.

In FIG. 2, the first embodiment shows the different configurations of the narrower radius golf club grip 15 and the wider radius golf club grip 17 as they both would be seized and secured within the various seating position areas 7. The radius of the golf club grip end determines how far into the volumes of space the golf club grip end can travel. In FIG. 2, if the radius of the narrow radius golf club grip 15 is small enough, then the narrow radius grip 15 can ultimately travel all the way through the volume of void space created by partitions 3 from partition apex 13 all the way to the top surface of bottom plate 1 within the grip seating position area 7 near the partition bases 11. If however the golf club grip end is the wider radius golf grip 17, then the wider radius grip 17 may not travel all the way to bottom plate 1 but rather will contact and be seated upon the tapered surfaces of the partitions 3.

At the apex of each partition 3 is fixedly attached, or formed as part thereof, an upwardly pointing flexible deflector tip 5. The flexible deflector tip 5 is comprised of a material that is less rigid and more flexible than partition 3. The deflector tip 5 is capable of being resiliently bent to at least 90 degrees from vertical, in any direction, when a weight of the golf club is applied at the top end of the deflector tip 5. When the weight of the single golf club is removed from the top end of the deflector tip 5, the deflector will almost instantly return to a vertical position relative to the bottom plate 1. The comprising material of deflector tip 5 is such that deflector tip 5 can be repeatedly twisted or bent with little or no damage to the capability of deflector tip 5 returning rapidly to its normally upright position.

FIG. 2 shows a deflector tip 5 in action as a deflected grip end of a golf club 19 inadvertently attempts to come into contact with the partition apex 13 of partition 3. The deflector tip 5 serves to guide a misplaced golf club grip end. When there is an attempt to seat a golf club grip end into the embodiment device, if the deflector tip 5 of the partition 3 is encountered, instead of the empty volume of the next available grip seating position area 7, the deflector tip 5 bends and the deflected golf club 19 is seated into the next available adjacent and empty seating position area 7.

As shown in FIG. 3 the embodiment of the Anti-Movement Base for Seizing and Deflecting Multi-Sized Golf Club Grips is shown in its installed configuration. Here, an Anti-Movement Golf Bag Base in its installed configuration 21 is fixedly attached to the bottom end of a golf bag 9. The installed base 21 can be permanently mounted or removably attached to golf bag 9. However, in use, the installed base 21 must be securely attached to the bottom end of golf bag 9 such that it can accommodate the weight of an entire set of golf clubs appropriate for the bag and can withstand golf clubs being removed and inserted without the base 21 becoming detached from the golf bag 9. Also shown in this FIG. 3 are an example narrow radius grip end 23 and a wide radius grip end 25 stored within the grip seating position areas of the installed base 21.

Operation

As shown in FIGS. 1-3, in operation, the installed base 21 serves to securely hold golf clubs and prevent their narrow radius grip ends 23 or wide radius grip ends 25 from contacting one another and becoming disorganized in the golf bag. The user merely inserts the grip end of a golf club into the top opening of a golf bag and while holding the wide end of the golf club, guides the club through the bag in a vertical manner and encounters the installed base 21. If the user, while positioning the golf club within the golf bag encounters the deflector tip 5 located at the tip of partition 3, then deflector tip 5 will bend and merely deflect the deflected golf club 19 into the next available seating position area 7.

Once the user feels that the club grip end is located with the seating position area 7, the user merely gives the club a final gentle downward push or twist to frictionally seize and secure the club within the seating position area 7. The user continues to do this with all remaining golf clubs until all have been securely stored within the golf bag via the base 21. When the user desires to remove a golf club, the user merely holds the play end of the golf club and pulls gently in a upward fashion, to frictionally release the club's grip end from the seating area 7, and while continuing to pull in an upward fashion, removes the club from the top open end of the golf bag. If the user desires, he can also add a slight rotational movement while gently pulling upward to release the club grip end from the seating area 7. FIG. 2 shows the resulting seized and secured seating position of clubs of various grip end radii. The narrow radius grip end 15, because this golf club's grip end has a narrow radius, becomes seated almost to the top surface of bottom plate 1. This is because in this example, the narrower grip end 15 has a narrower radius that is almost equal, but less, than the maximum distance between the set of partitions 3 that define the lower end of this particular seating position area 7. The wider radius grip end 17, because this golf club's grip end has a wider radius, becomes seated at some distance above the top surface of bottom plate 1, and rests at a distance further in an upwardly direction from bottom plate 1 than did the narrower radius grip end 15. This is because in this example, the wider radius grip end 17 has a radius that is almost equal but does not exceed, the maximum distance between the upper surfaces of partitions 3 that define the upper end of this particular seating position area 7.

Advantages

The present embodiment may have one or more of the following advantages:

One advantage of the embodiment is deflector tips 5 enable the golf club grip ends to be automatically directed to the next available and adjacent holding position even if the golf bag does not have partition walls or dividers within the bag.

Another advantage of the embodiment is the deflector tips 5 are flexible and can rotate 360 degrees, this bending and rotational movement allows the golf club grips to move to and seek their prospective holding position.

Another advantage of the embodiment is the deflector tips 5 direct the golf club grips to a secure holding position therefore the clubs do not ride upon a flat plateau area which is a non-secured position.

Another advantage of the embodiment is that the tapered surfaces of the partitions 3 can secure any size club grip regardless of the golf club grip's diameter

We claim:

1. A golf club holder base for installation within a golf bag comprising:

(a) a bottom mounting plate having a top surface and a bottom surface with said bottom mounting plate being attached to an interior lower end of a golf bag, and (b) a plurality of conically shaped partitions are formed upon said top surface, and (c) each said partition is wider at a base end and extends upwardly and inwardly at an angle to terminate at an apex end, and (d) said partitions are situated adjacently with one another upon said top surface to define a volume of space between at least two of said partitions, and (e) said volume of space is sized for receiving only one of a plurality of grip ends belonging to a set of wide and narrow gripped golf clubs, and (f) each said partition has an outer surface that is capable of frictionally seizing and frictionally releasing said grip ends of the golf clubs, and (g) each said apex end of each said partition is coupled with a flexible deflecting tip, and (h) said flexible deflecting tip is adapted to resiliently deflect said grip ends of the golf clubs for assisting in seating said grip end of the golf club into a next adjacent and unoccupied said volume of space, wherein said deflecting tip is more flexible than said partition.

2. The golf club holder base of claim 1, wherein said partitions are made from a material that is more rigid and less flexible than the material of said deflecting tips.

3. The golf club holder base of claim 1, wherein said flexible deflector tip is cylindrically shaped and extends vertically from with the partition.

4. The golf club holder base of claim 1, wherein said partition is a separate component from said top surface but is securely attached to said top surface.

5. The golf club holder base of claim 1, wherein said flexible deflector tip is a separate component from said partition but is securely attached to said apex end of said partition.

6. The golf club holder base of claim 1, wherein said bottom mounting plate is removably attached to said golf bag.

7. The golf club holder base of claim 1, wherein said flexible deflector tip has a cross-sectional area less than the cross-sectional area of said partition base end.

8. The golf club holder base of claim 7, wherein said flexible deflector tip has a cross-sectional area approximately the same or less than the cross-sectional area of said partition apex end.

9. The golf club holder base of claim 1, wherein said flexible deflector tip is made of a flexible material and said partition is made of a rigid material.

10. The golf club holder base of claim 9, wherein the outer surface of said partition is made of a different material than the partition.

11. A method of storing golf clubs within a golf bag comprising the steps of:

(a) attaching a bottom mounting plate having a top surface and a bottom surface to an interior lower end of a golf bag, wherein said top surface has a plurality of conically shaped partitions formed thereupon wherein each said partition is wider at a base end and extends upwardly and inwardly at an angle to terminate at an apex end, and wherein said partitions are situated adjacently with one another upon said top surface to define a volume of space within said partitions, and wherein said volume of space is sized for receiving only one of a plurality of grip ends belonging to a set of wide and narrow gripped golf clubs, and wherein each said partition has an outer surface that is capable of frictionally seizing and frictionally releasing said grip ends of the golf clubs, and wherein each said apex end of each said partition is itself coupled to a flexible deflecting tip, and wherein said deflecting tip is adapted to resiliently deflect said grip ends of the golf clubs for assisting in seating said grip end of the golf club into a next adjacent and unoccupied said volume of space, wherein said deflector tip is more flexible than said partition;

(b) obtaining a golf club desired to be stored within a golf bag said golf club having said grip end and an opposite upper head end;

(c) grasping said golf club near the upper head end and manually inserting said grip end of the golf club down and into an interior region of the golf bag into said volumes of space formed within said partitions;

(d) upon encountering said deflecting tip, continuing to insert the golf club into said volume of space until the golf club can be inserted no further into the golf bag;

(e) giving the golf club a slight twist to secure and seat it within said volume of space.

12. The golf club holder base of claim 1, comprising wherein said flexible deflector tip is capable of being resiliently bent to at least 90 degrees from vertical in any direction.

13. A golf club holder base configured for installation within a golf bag comprising:

a plate configured to attach to a bottom portion of the golf bag; and a plurality of vertical conical protrusions coupled to the plate, wherein each protrusion has a base area that is larger than an apex end area of the protrusion, wherein at least two of the plurality of protrusions are arranged to contact a grip end of a golf club, wherein at least one of the plurality of protrusions is coupled to a deflector tip that is more flexible than the protrusion, wherein said deflector tip is capable of guiding the end of a golf club into an unoccupied volume of space between at least two of the plurality of protrusions.

14. The golf club holder base of claim 13, further comprising a volume of space between at least three of the plurality of protrusions that is configured to receive a plurality of differently sized grip ends belonging to a set of golf clubs.

15. The golf club holder base of claim 13, further comprising a volume of space between at least three of the plurality of protrusions that is configured to receive only one of a plurality of grip ends belonging to a set of golf clubs.

16. The golf club holder base of claim 13, wherein each protrusion has an outer surface that is capable of frictionally seizing and releasing said grip ends of the golf clubs.

17. The golf club holder base of claim 16, wherein the outer surface is of a different material than the protrusion.

18. The golf club holder base of claim 13, wherein the deflector comprises a flexible tip that is capable of being resiliently bent to at least 90 degrees from vertical in any direction.

19. The golf club holder base of claim 13, comprising wherein said flexible deflector tip is made of a material that is less rigid and more flexible than the material of said partition.

20. The golf club holder base of claim 13, comprising wherein said flexible deflector tip is a separate component from said partition but is securely attached to said apex end of said partition.

* * * * *